US005493872A

United States Patent [19]

Hibino et al.

[11] Patent Number: 5,493,872

[45] Date of Patent: Feb. 27, 1996

[54] WATER SPRINKLING APPARATUS FOR ICE MAKING MACHINE

[75] Inventors: Takashi Hibino, Chita; Nobutaka Naruse, Toyoake; Shozo Ogata, P.T.C., all of Ga.

[73] Assignee: Hoshizaki Denki Kabushiki Kaisha, Aichi, Japan

[21] Appl. No.: 266,642

[22] Filed: Jun. 28, 1994

[30] Foreign Application Priority Data

Jun. 28, 1993 [JP] Japan ..... 5-034991 U

[51] Int. Cl.[6] ..... F25C 1/12

[52] U.S. Cl. ..... 62/347; 239/600

[58] Field of Search ..... 62/347; 239/556, 239/600

[56] References Cited

U.S. PATENT DOCUMENTS

| | | | |
|---|---|---|---|
| 2,771,131 | 11/1956 | Hook et al. | 239/556 X |
| 4,601,176 | 7/1986 | Suyama | 62/347 X |
| 4,657,709 | 4/1987 | Goettl | 239/556 X |
| 4,791,792 | 12/1988 | Naruse et al. | 62/347 X |
| 4,903,505 | 2/1990 | Sakai et al. | 62/347 |
| 5,237,837 | 8/1993 | Naruse et al. | 62/347 X |

*Primary Examiner*—William E. Tapolcai
*Attorney, Agent, or Firm*—Wenderoth, Lind & Ponack

[57] ABSTRACT

A water sprinkling apparatus for an ice making machine includes an icing water sprinkler comprised of a plurality of broad-width water strewing cylinders extending in parallel with one another with a distance therebetween and formed in an integral structure and a deicing water sprinkler comprised of a plurality of narrow-width water strewing cylinders extending along respective bottom surfaces of the plurality of broad-width water strewing cylinders and formed in an integral structure. Each of the broad-width water strewing cylinders and each of the narrow-width water strewing cylinders have pluralities of water strewing holes and formed distributively in the respective bottom walls. The water strewing holes are preferably formed simultaneously with molding of the icing water sprinkler and the deicing water sprinkler. A bottom surface of each of the broad-width water strewing cylinders of the icing water sprinkler is engaged with a top surface of each of the narrow-width water strewing cylinders of the deicing water sprinkler by fitting a stripe-like protrusion formed in either the bottom surface or the top surface in a longitudinal recesses formed in either the top or bottom surface.

10 Claims, 5 Drawing Sheets

WATER SPRINKLING APPARATUS FOR ICE MAKING MACHINE

BACKGROUND OF THE INVENTION

1. Field of the Invention

The present invention relates to a structure of a water sprinkling apparatus which is employed in an ice making machine such as a water flow-down type ice making machine for supplying raw water consumed in making ice (this water will hereinafter be referred to as "icing water" only for convenience of description) as well as water for removing or extracting ice pellets or cubes as formed (this water will hereinafter be referred to as "deicing water" only for convenience of description).

2. Description of the Related Art

In general, in a water flow-down type ice making machine, a pair of ice making plates are vertically disposed in a back-to-back opposite relation, wherein a refrigerating pipe (i.e., evaporator in which a coolant is evaporated) is mounted in a state sandwiched between back or rear surfaces of the pair of ice making plates. More specifically, the refrigerating pipe is disposed in intimate contact with the rear surfaces of the ice making plates for cooling icing water strewed from a water sprinkling apparatus disposed above the ice making plates and flowing downwardly along front or exposed surfaces of the ice making plates in the ice making operation.

In the ice extracting operation which follows the ice making operation, a hot gas (high-temperature gas not condensated) is forced to flow through the refrigerating pipe to heat the ice making plates for melting the ice pellets as formed at the surfaces adhering to the ice making plates. Thus, the ice pellets are separated from the ice making plates to be discharged outwardly. Since most of the hot gases used to this end are of relatively small thermal capacity, deicing water for promoting the melting and separation or detachment of ice pellets is generally caused to flow between the rear surfaces of the pair of ice making plates. To this end, the water sprinkling apparatus disposed above the ice making plates is also provided with a water passage and water strewing holes which are to be used to flow deicing water in the deicing operation. In other words, the water sprinkling apparatus for the water flow-down type ice making machine is realized in the form of an assembly of an icing water sprinkler and a deicing water sprinkler.

The icing water sprinkler constitutes a part of a water supply loop for circulating water between a water tank and a water collector disposed below the ice making plates and serves to strew a relatively large amount of water on the front surfaces of the pair of ice making plates, while the deicing water sprinkler is adapted to strew a relatively small amount of tap water between the rear surfaces of the ice making plates. For this reason, the icing water sprinkler and the deicing water sprinkler are implemented in the structures suited for realizing the respective functions. In an ice making machine in which the water strewing holes of the icing water sprinkler and those of the deicing water sprinkler are at a same level (or height), there are adopted some specific measures for allowing water as strewed from the icing water sprinkler or the deicing water sprinkler to be properly directed to the front surfaces (ice making surfaces) of the ice making plates or rear surfaces thereof. Reference may be made to, for example, Japanese Utility Model Application Laid-Open No. 63-66775.

As a water sprinkling apparatus of the type mentioned above, there is known heretofore such structure and configuration as shown in FIGS. 7, 8 and 9 of the accompanying drawings. Referring to FIG. 7 which shows schematically a cross section of the conventional water sprinkling apparatus, a sprinkler body 5 is formed in a substantially uniform thickness through an extrusion molding process, wherein an icing water flow passage 1 of a relatively large volume is defined above a deicing water flow passage 3 of a relatively small volume. Linear arrays of water strewing holes 1*a* and 1*b* are formed in juxtaposition in the bottom wall of the icing water flow passage 1. Similarly, a linear array of deicing water strewing holes 3*a* is formed in the bottom wall of the deicing water flow passage 3. The water strewing holes 1*a*, 1*b* and 3*a* are formed by using a drill or the like tool, and are clearly shown in FIG. 8.

The sprinkler body 5 of the water sprinkling apparatus which includes the icing water flow passage 1 and the deicing water flow passage 3 is obtained by cutting a corresponding extrusion product in a predetermined length. A plug 7 is mounted on a distal end of the sprinkler body 5 while a water supply connector 9 is fixed to the other end portion of the sprinkler body 5. The connector 9 is provided with an icing water supply port 9*a* and a deicing water supply port 9*b* which are in fluid communication with the icing water flow passage 1 and the deicing water flow passage 3, respectively. The plug 7 and the water supply connector 9 are conventionally made of a synthetic resin. It will now be understood that a water sprinkling apparatus 10 for an ice making machine is constituted by the sprinkler body 5, the plug 7 and the water supply connector 9 attached to the sprinkler body 5.

In a water sprinkling apparatus for an ice making machine in which a plurality of water sprinkling apparatuses 10 are employed in correspondence to plural pairs of ice making plates, an icing water supply joint 11 and a deicing water supply joint 12 are used to interconnect the icing water supply ports 9*a* and the deicing water supply ports 9*b* of the connectors 9, respectively, as shown in FIG. 9.

In the above-mentioned conventional water sprinkling apparatuses for ice making machines, the sprinkler body 5 is manufactured in an integral structure by an extrusion molding with a uniform wall thickness. As a result of this, the bottom wall of the sprinkler body 5 is of a same thickness as the other walls and is ratter thin. Accordingly, water streams that jet from the sprinkler body 5 through the strewing holes 1*a*, 1*b* and 3*a*, mechanically pierced through relatively thin bottom walls, tend to be inclined toward the direction in which water flows through the passage defined within the sprinkler body 5, giving rise to a problem that ice pellets or cubes being formed are susceptible to deformations.

Further, because the conventional water sprinkling apparatus for an ice making machine is constituted by assembling a variety of individual parts, substantial amounts of time are required for machining and the assembling operations. Besides, the structure is likely to be complicated. These problems become more serious when a large number of the sprinkler bodies are to be interconnected. Upon assembling the individual parts, precautions have to be taken for preventing water leakage. Also, after assembly, a test for detecting presence or absence of water leakage will have to be performed (with unsatisfactory products being discarded). As is apparent from the above, time consuming and troublesome processes are involved in manufacturing the conventional water sprinkling apparatus for an ice making machine.

SUMMARY OF THE INVENTION

It is therefore an object of the present invention to provide a water sprinkling apparatus for an ice making machine which can easily be manufactured in a simplified structure and which can nevertheless ensure high reliability of operation.

In order to achieve the above objects, there is provided according to a general aspect of the present invention a water sprinkling apparatus for an ice making machine, which comprises an icing water sprinkler including a plurality of broad-width water strewing cylinders extending in parallel with one another with a distance therebetween and formed in an integral structure, and a deicing water sprinkler including a plurality of narrow-width water strewing cylinders extending along respective bottom surfaces of the plurality of broad- width water strewing cylinders of the icing water sprinkler, and formed in an integral structure. Each of the broad-width water strewing cylinders of the icing water sprinkler and each of the narrow-width water strewing cylinders of the deicing water sprinkler have pluralities of water strewing holes formed in and distributed along bottom walls of the broad-width water strewing cylinders and the narrow-width water strewing cylinders, respectively.

In the water sprinkling apparatus for an ice making machine according to the present invention, the icing water sprinkler including a plurality of broad-width icing water strewing cylinders can be formed in an integral structure, for example, by a blow molding operation, wherein an icing water flow passage can be defined within each of the strewing cylinders in a fluid-tight manner. The icing water can be strewed through the water strewing holes (which may be formed simultaneously by the molding or subsequently by means of a drill or the like piercing tool) in the direction toward the ice making surfaces of the ice making plates. Similarly, the deicing water sprinkler including a plurality of narrow-width water strewing cylinders can also be formed, for example, by a blow molding operation in an integral structure having deicing water flow passages formed therein fluid-tightly. Upon a deicing operation, deicing water fed into the deicing water flow passage is sprinkled from the strewing holes formed in the bottom wall toward relevant portions located on or between the ice making plates. The deicing water strewing holes may be formed simultaneously by the molding or subsequently by means of a drill or the like piercing tool. The icing water sprinkler and the deicing water sprinkler manufactured as separate units can be assembled together with high rigidity by press-fitting an integrally formed stripe-like protrusion into a recess of a corresponding shape.

DESCRIPTION OF THE PREFERRED EMBODIMENTS

Now, the present invention will be described in detail in conjunction with preferred embodiments thereof by reference to the accompanying drawings, in which identical reference numbers denote the same or equivalent parts throughout the several figures. Although it is assumed in the following description that water strewing holes are formed simultaneously with the molding of a water sprinkler, it should be understood that the former may be formed by piercing or like machining after the molding of the latter.

Figure 1:
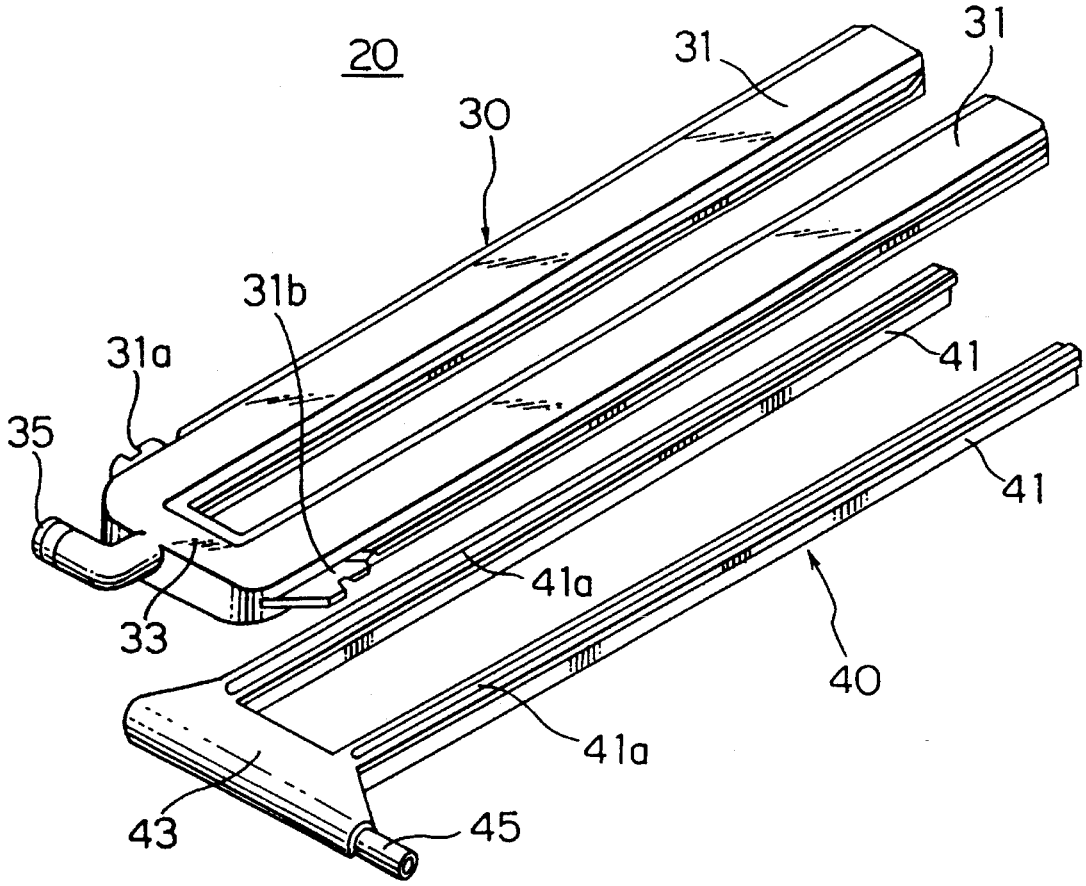
FIG. 1 is an exploded perspective view showing, as viewed from above, a water sprinkling apparatus for an ice making machine according to an embodiment of the present invention.

FIG. 1 shows in an exploded perspective view a water sprinkling apparatus 20 for an ice making machine according to an embodiment of the invention. As can be seen from the figure, the water sprinkling apparatus 20 comprises an icing water sprinkler 30 and a deicing water sprinkler 40. The icing water sprinkler 30 includes a pair of elongated water strewing cylinders 31 each having a substantially rectangular cross section with a broad width. The broad-width water strewing cylinders 31 are joined together by a coupling portion 33 to thereby constitute the icing water sprinkler 30 in an integral and one-piece structure as shown. At this juncture, it should be mentioned that although the icing water sprinkler 30 includes a pair of the broad-width water strewing cylinder 31 which extend in parallel with each other in the case of the illustrated water sprinkling apparatus, the former may be implemented with three, four or more water strewing cylinders 31 joined together by using a coupling member 33 of a corresponding structure, as readily will be understood by those skilled in the art. A water supply joint 35 of a substantially L-shape projects from the coupling portion 33. Further, stoppers **31*a* and 31*b* are integrally formed with the broad-width icing water strewing cylinders 31** at respective outer shoulder portions thereof.

On the other hand, the deicing water sprinkler 40 is constituted by a pair of narrow-width deicing water strewing cylinders 41 each having a substantially rectangular or elliptical section with a narrow width, wherein the narrow-width deicing water strewing cylinders 41 are disposed in parallel with each other in correspondence to the broad-width icing water strewing cylinders 31. The narrow-width deicing water strewing cylinders 41 are joined together by a coupling portion 43 to constitute the deicing water sprinkler 40 of an integral and one-piece structure as shown. The deicing water sprinkler 40 as well as the icing water sprinkler 30 may be manufactured through a blow-molding process. A tubular water supply joint 45 is formed integrally with the coupling portion 43 at one end thereof. It should further be noted that a stripe-like protrusion 41a is formed on a top surface of each of the narrow-width deicing water strewing cylinders 41 for a purpose which will be described below.

Figure 2:
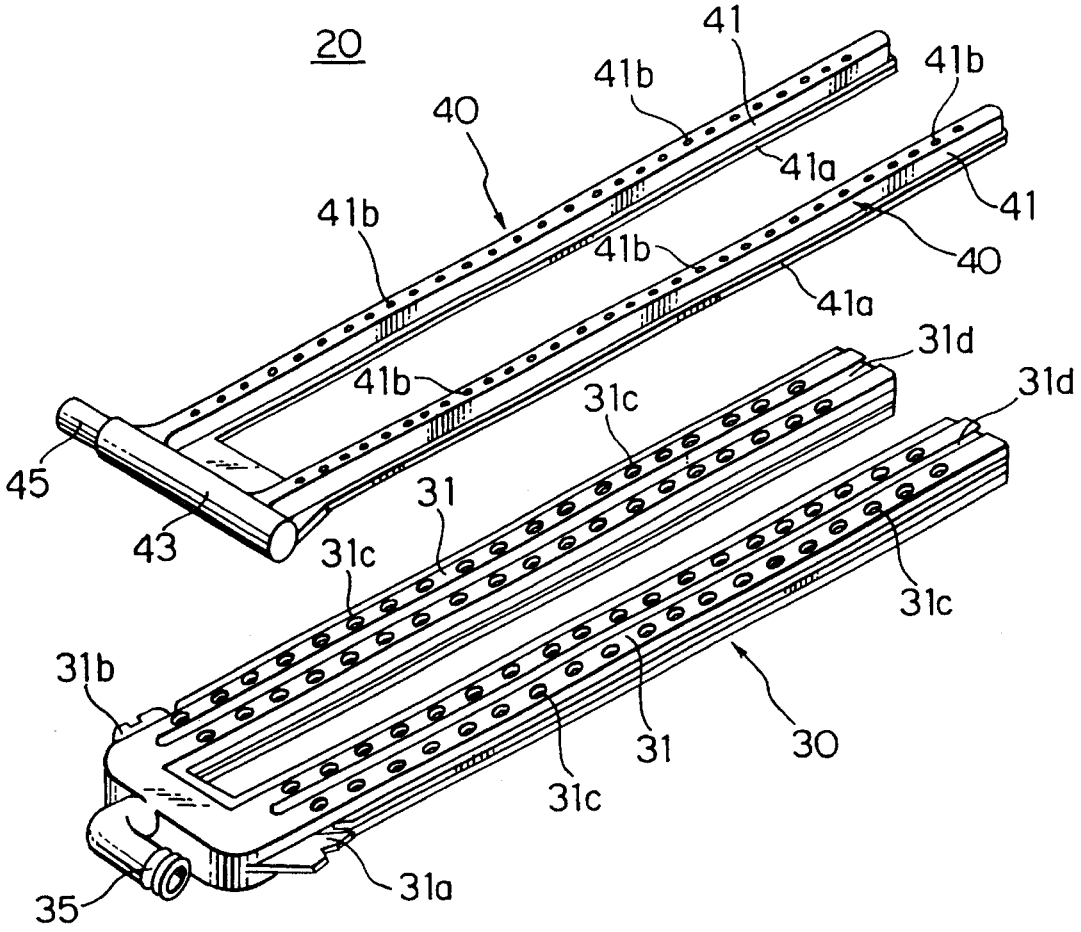
FIG. 2 is an exploded perspective view of the apparatus of FIG. 1 as viewed from the bottom thereof.

FIG. 2 shows the water sprinkling apparatus 20 in an exploded perspective view, as viewed from the bottom side. As can be seen in the figure, there are formed a large number of water strewing holes 31*c* in a bottom wall of each of the broad-width icing water strewing cylinders 31. Similarly, a large number of deicing water strewing holes 41*b* are formed in a bottom wall of each of the narrow-width deicing water strewing cylinders 41. The icing water strewing holes 31*c* are communicated with an icing water passage defined fluid-tightly within the broad-width strewing cylinder 31, while the water strewing holes 41*b* are communicated with a deicing water passage defined fluid-tightly within the narrow-width strewing cylinder 41. Additionally, a longitudinal recess 31*d* is integrally formed in a bottom surface of each of the broad-width icing water strewing cylinders 31. Each stripe-like protrusion 41*a* mentioned above is adapted to be snugly fitted in a respective longitudinal recess 31*d*.

Figure 4:
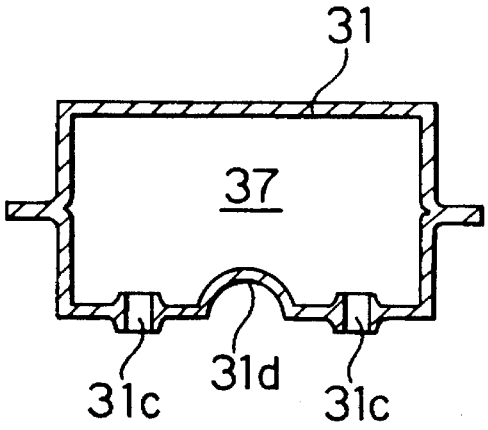
FIG. 4 is a fragmentary sectional view of an icing water strewing cylinder.
Figure 5:
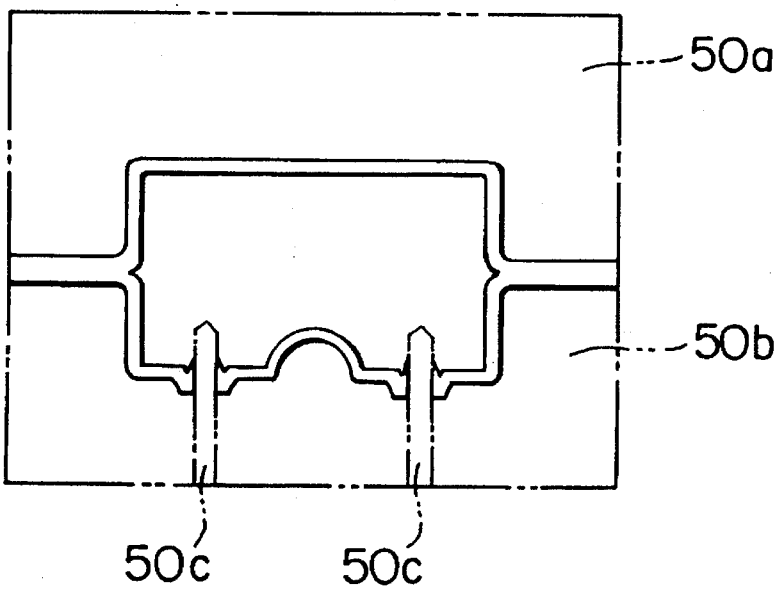
FIG. 5 is a view illustrating a molding method of manufacturing an icing strewing cylinder.

FIG. 4 is a cross sectional view of the broad-width icing water strewing cylinder 31 which shows an icing water passage 37. The broad-width icing water strewing cylinder 31 may be manufactured by an injection blow molding operation by using a mold which is constituted by a combination of an upper die 50*a*, a lower die 50*b* and pins 50*c*, as shown in FIG. 5. In order to manufacture a defect-free product, precaution should be paid so that spaces around the pins 50*c* are filled with a sufficient amount of material to thereby form thick peripheral portions around respective strewing holes 31*c*. The deicing water sprinkler 40 may also be manufactured by using a similar injection blow molding process.

Figure 3:
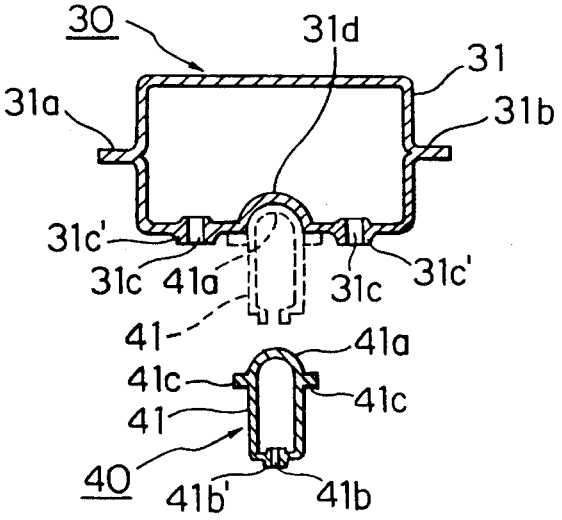
FIG. 3 is a fragmentary sectional view illustrating a manner in which water strewing cylinders of an icing water sprinkling member and a deicing water sprinkling member are assembled together.

As can be seen from FIGS. 3 to 5, when those portions of the bottom walls of the broad-width icing water strewing cylinder 31 which surround the water strewing holes 31*c*, respectively, are thickened to thereby form annular protrusions 31*c*' generally of a convex form around the longitudinal axes of the strewing holes 31*c*, these protrusions 31*c*' cooperate with so-called burrs formed unavoidably along the inner peripheral edges of the strewing holes 31*c* in the injection blow molding operation to increase the length of the strewing holes 31*c*. Therefore, the icing water can be discharged just downwardly through the strewing holes 31*c*, resulting in that icing water can flow down uniformly over and along surfaces of ice making plates, whereby formation of ice pellets or blocks of irregular form can be avoided. Furthermore, when the icing water strewing holes 31*c* are formed simultaneously and integrally with the broad-width icing water strewing cylinder 31 through the injection blow molding operation, it is possible to make the diameter and the depth of the individual strewing holes 31*c* different from one to another so that icing water can be sprinkled uniformly along the direction longitudinally of the broad-width strewing cylinder 31, which contributes to realization of uniform flow of water along the ice making plate. This feature is also advantageous in that generation of ice pellets of irregular shapes can be suppressed. The water strewing holes 41*b* of the deicing water sprinkler 40 may be formed so as to be surrounded by annular protrusions 41*b*' (see FIGS. 3 and 6) as in the case of the icing water sprinkler 30, to thereby allow deicing water to flow down uniformly.

FIG. 3 illustrates a method of assembling together the icing water sprinkler 30 and the deicing water sprinkler 40 manufactured of the structures described above. As can be seen from the figure, the stripe-like protrusion 41*a* formed on the narrow-width deicing water strewing cylinder 41 is snugly fitted in the longitudinal recess 31*d* formed in the broad-width icing water strewing cylinder 31. A pair of horizontal stopper plates 41*c* are formed integrally with the narrow-width deicing water strewing cylinder 41 at both sides thereof, respectively, and adapted to bear against the bottom surface of the broad-width icing water strewing cylinder 31 upon assembling together of the broad-width icing water strewing cylinder 31 and the narrow-width deicing water strewing cylinder 41.

Figure 6:
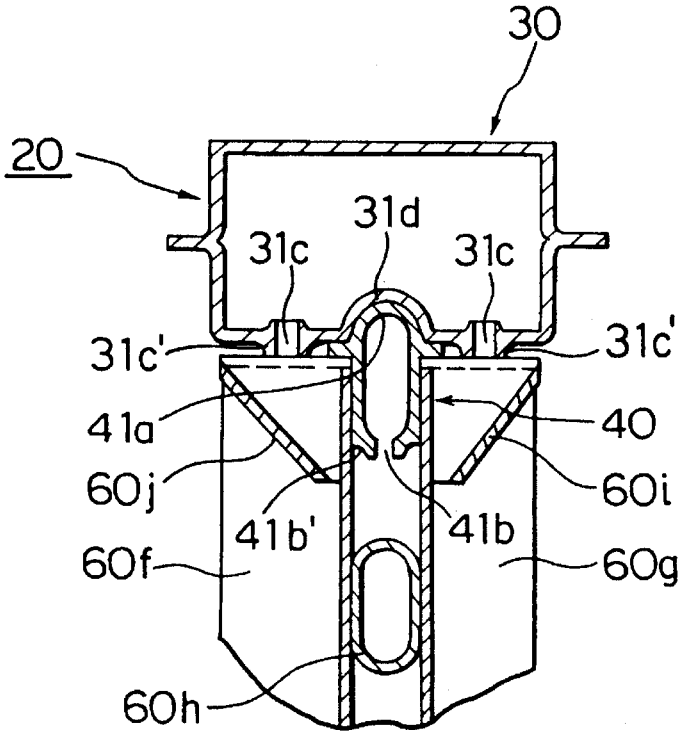
FIG. 6 is a view illustrating operation of the water sprinkling apparatus shown in FIG. 1.
Figure 7:
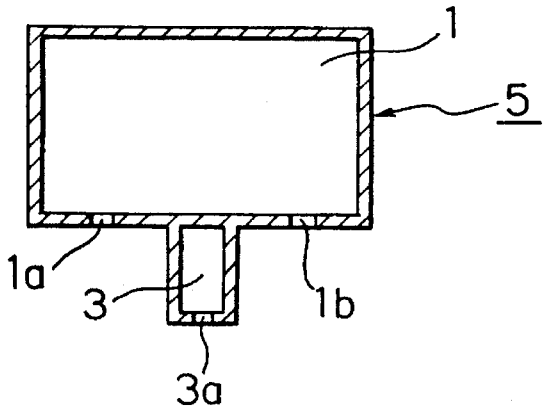
FIG. 7 PRIOR ART
FIG. 7 is a fragmentary sectional view showing a structure of a water sprinkling member employed in a conventional water sprinkling apparatus.
Figure 8:
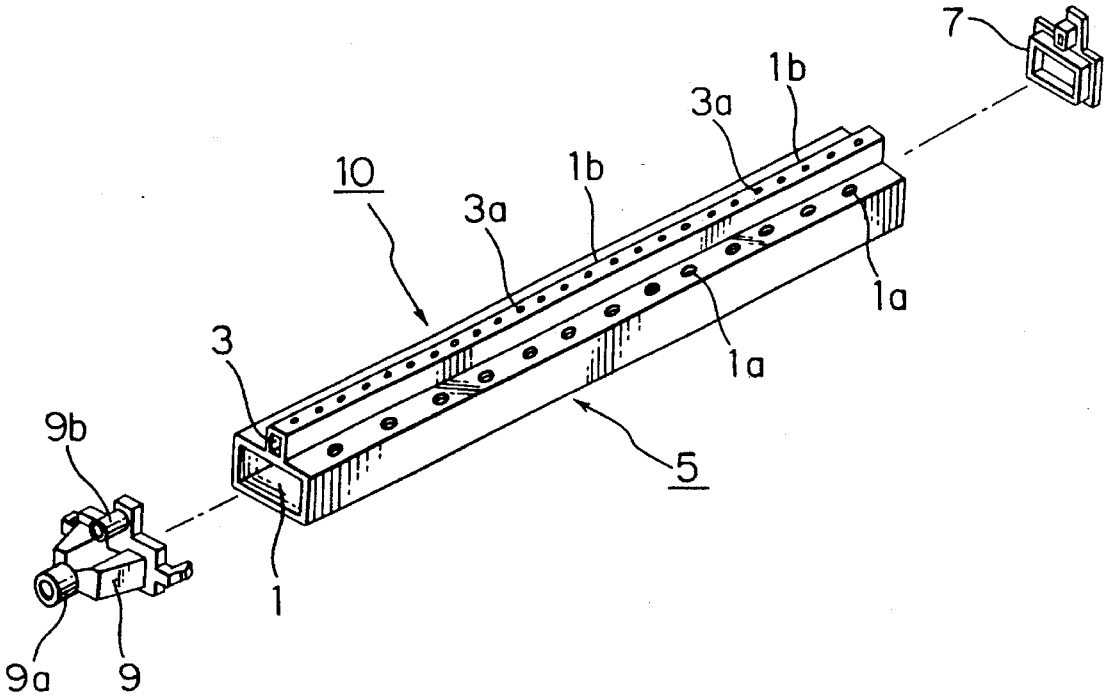
FIG. 8 PRIOR ART
FIG. 8 is an exploded perspective view showing a major portion of the conventional water sprinkling apparatus.
Figure 9:
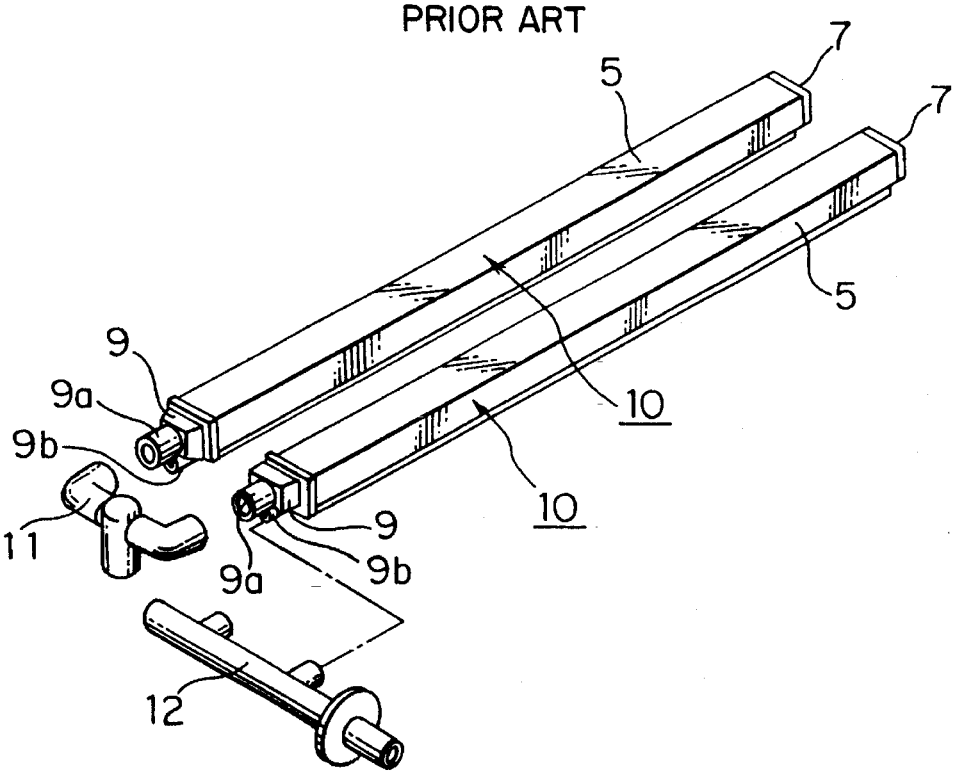
FIG. 9 PRIOR ART
FIG. 9 is an exploded perspective view illustrating a structure of the conventional water sprinkling apparatus.

FIG. 6 shows schematically a structure of an ice making machine in which the water sprinkling apparatus 20 assembled from the icing water sprinkler 30 and the deicing water sprinkler 40 is incorporated. Referring to the figure, a pair of ice making plates 60*f* and 60*g* are disposed in a back-to-back opposite relation, and an evaporator or refrigerating pipe 60*h* through which a coolant flows is disposed between the ice making plates 60*f* and 60*g*. A substantially lower half of the deicing water sprinkler 40 extends between the ice making plates 60*f* and 60*g*. The deicing water sprinkler 40 is supplied with deicing water such as tap water from water service equipment to strew it when ice pellets as formed are to be removed or taken out (i.e., deiced). A pair of water guide plates 60*i* and 60*j* are mounted at upper portions of the ice making plates 60*g* and 60*f*, respectively, substantially in a V-like pattern for deflecting water strewed from the icing water sprinkler 30 toward the surfaces of the ice making plates 60*f* and 60*g*, i.e., onto the icing surfaces, respectively, whereby an ice making process is carried out.

As is apparent from the foregoing description, in the water sprinkling apparatus 20 according to the invention, each of the icing water sprinkler 30 and the deicing water sprinkler 40 are manufactured in an integral structure by a molding operation. The water strewing holes may be formed simultaneously with the molding of the icing water sprinkler 30 or the deicing water sprinkler 40 or alternatively they may be formed subsequently by using a drill or the like piercing tool. In the former case, additional machining such as piercing is rendered unnecessary. In any case, the wall portion surrounding the strew hole is increased to a desirable thickness which is effective for strewing water most favorably for the formation or growth of ice manufacturing. In other words, water can be sprinkled uniformly, whereby generation of ice pellets of irregular forms can satisfactorily be suppressed. Besides, owing to the integral structures of the icing water sprinkler 30 and the deicing water sprinkler 40 formed by blow molding operation, there exist no joints which may provide a cause for water leakage. Additionally, manufacture of the icing water sprinkler 30 and the deicing water sprinkler 40 can be facilitated and simplified because there is no need for assembling a plurality of parts. Finally, the icing water sprinkler 30 and the deicing water sprinkler 40 and hence the water sprinkling apparatus 20 can enjoy high rigidity and a long useful life, while ensuring a high reliability of operation.

It should further be added that although the icing water sprinkler 30 and the deicing water sprinkler 40 are manufactured as separate units, they can be assembled together with high rigidity by press-fitting the integrally formed stripe-like protrusion in the recess of a corresponding shape.

What is claimed is:

1. A water sprinkling apparatus for an ice making machine, said apparatus comprising:

an icing water sprinkler including a plurality of relatively broad width icing water strewing cylinders spaced from and extending parallel to each other, said icing water sprinkler comprising an integral, one-piece structure;

a deicing water sprinkler including a plurality of relatively narrow width deicing water strewing cylinders extending along bottom surfaces of respective of said plurality of icing water strewing cylinders, said deicing water sprinkler comprising an integral, one-piece structure;

each of said icing water strewing cylinders and each of said deicing water strewing cylinders having a respective bottom wall, each said bottom wall having formed therein and distributed thereover a respective plurality of water strewing holes; and a top surface of each said deicing water strewing cylinder being engaged with said bottom surface of a respective said icing water cylinder by a stripe-like protrusion on one of said top surface or said bottom surface fitting into a longitudinal recess formed in the other of said bottom surface or said top surface.

2. An apparatus as claimed in claim 1, wherein said integral, one-piece structure of said deicing water sprinkler and said integral, one-piece structure of said deicing water sprinkler each result from formation thereof by respective blow-molding operations.

3. An apparatus as claimed in claim 2, wherein each said plurality of strewing holes results from formation thereof simultaneously with molding of the respective said water sprinkler.

4. An apparatus as claimed in claim 1, wherein each said deicing water strewing cylinder has side portions having extending therefrom respective stops that are in contact with said bottom surface of said respective icing water strewing cylinder.

5. An apparatus as claimed in claim 1, wherein said integral one-piece structure of said icing water sprinkler includes a coupling member integral and unitary with said icing water strewing cylinders.

6. An apparatus as claimed in claim 5, wherein said integral one-piece structure of said deicing water sprinkler includes a coupling integral and unitary with said deicing water strewing cylinders.

7. An apparatus as claimed in claim 6, further comprising an icing water supply joint formed in and projecting from said coupling member, and a deicing water supply joint formed in and projecting from said coupling.

8. An apparatus as claimed in claim 1, wherein said integral one-piece structure of said deicing water sprinkler includes a coupling integral and unitary with said deicing water strewing cylinders.

9. An apparatus as claimed in claim 1, wherein each said water strewing hole in each said bottom wall of each said cylinder is formed through a thickened portion of said bottom wall.

10. An apparatus as claimed in claim 9, wherein each said thickened portion has a convex configuration extending coaxial of a longitudinal center axis of the respective said water strewing hole.

* * * * *